US009080363B2

(12) United States Patent
Reed et al.

(10) Patent No.: US 9,080,363 B2
(45) Date of Patent: Jul. 14, 2015

(54) VEHICLE DOOR SWING GOVERNOR

(75) Inventors: Eric L. Reed, Livonia, MI (US); Karl William Wojcik, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 30 days.

(21) Appl. No.: 13/418,443

(22) Filed: Mar. 13, 2012

(65) Prior Publication Data

US 2013/0239485 A1 Sep. 19, 2013

(51) Int. Cl.
*E05F 15/02* (2006.01)
*E05F 5/02* (2006.01)

(52) U.S. Cl.
CPC . *E05F 5/025* (2013.01); *Y10T 16/61* (2013.01)

(58) Field of Classification Search
CPC ..... E05F 5/025
USPC ..... 49/333, 334, 138, 502, 335
See application file for complete search history.

(56) References Cited

U.S. PATENT DOCUMENTS 1,543,935 A 6/1925 McGee
1,941,454 A 1/1934 Ainsworth
2,013,418 A 9/1935 Moore
2,032,724 A 3/1936 Sharpe
2,138,521 A 11/1938 Ellis
2,170,014 A 8/1939 Ellis
2,243,914 A 6/1941 Martin et al.
2,758,835 A 8/1956 Wikkerink
2,820,241 A 1/1958 Schlage
2,874,960 A 2/1959 Durbin et al.
3,023,854 A * 3/1962 Lohr ..... 188/83
3,061,362 A * 10/1962 Maruyama ..... 296/146.4
3,114,541 A 12/1963 Coffey
3,141,662 A * 7/1964 Wise ..... 49/280
3,284,950 A 11/1966 Gute
3,425,161 A 2/1969 Catlett et al.
3,645,042 A 2/1972 Bolli
3,653,154 A * 4/1972 Hayday ..... 49/280
3,934,306 A 1/1976 Farris
3,996,698 A 12/1976 Rees et al.
4,007,557 A 2/1977 Davis et al.
4,121,382 A * 10/1978 Dietrich et al. ..... 49/334
4,220,051 A 9/1980 Catlett
4,348,835 A 9/1982 Jones et al.
4,429,490 A 2/1984 Zunkel
4,498,033 A 2/1985 Aihara et al.
4,551,946 A 11/1985 Yoshida et al.
4,658,545 A 4/1987 Ingham et al.
4,785,493 A 11/1988 Tillmann et al.
4,972,629 A 11/1990 Merendino et al.
4,973,894 A 11/1990 Johansson
5,040,331 A 8/1991 Merendino et al.

(Continued)

FOREIGN PATENT DOCUMENTS

JP 2008025267 A * 2/2008
WO 2011019235 A2 2/2011

*Primary Examiner* — Jerry Redman
(74) *Attorney, Agent, or Firm* — Frank MacKenzie; Price Heneveld LLP

(57) ABSTRACT

A vehicle door swing governor is positioned between a door and a body of a vehicle. The door swing governor includes a motor and a controller for controlling the mechanical resistance applied by the motor to the door so as to control velocity of the door swing. The mechanical resistance applied to the door is a function of the velocity of the swing of the door.

15 Claims, 6 Drawing Sheets

(56) References Cited

U.S. PATENT DOCUMENTS

| | | | | |
|---|---|---|---|---|
| 5,063,337 | A | 11/1991 | Evin | |
| 5,193,647 | A | 3/1993 | O'Brien, II | |
| 5,243,735 | A | 9/1993 | O'Brien, II | |
| 5,278,480 | A | 1/1994 | Murray | |
| 5,392,562 | A | 2/1995 | Carambula | |
| 5,497,461 | A | 3/1996 | Matsumoto et al. | |
| 5,543,692 | A | 8/1996 | Howie et al. | |
| 5,594,316 | A | 1/1997 | Hayashida | |
| 5,634,296 | A | 6/1997 | Hebda | |
| 5,687,507 | A | 11/1997 | Beran | |
| 5,727,348 | A | 3/1998 | Arnell et al. | |
| 5,770,934 | A * | 6/1998 | Theile | 318/469 |
| 5,789,887 | A * | 8/1998 | Elischewski | 318/468 |
| 5,838,129 | A | 11/1998 | Luh | |
| 5,878,530 | A | 3/1999 | Eccleston et al. | |
| 5,910,075 | A | 6/1999 | Arnell et al. | |
| 5,930,954 | A | 8/1999 | Hebda | |
| 5,956,249 | A | 9/1999 | Beran et al. | |
| 5,977,732 | A * | 11/1999 | Matsumoto | 318/283 |
| 6,006,475 | A | 12/1999 | Schwantes et al. | |
| 6,038,895 | A | 3/2000 | Menke et al. | |
| 6,061,964 | A | 5/2000 | Arnell et al. | |
| 6,067,753 | A | 5/2000 | Hebda | |
| 6,430,871 | B1 | 8/2002 | Hebda | |
| 6,452,353 | B1 * | 9/2002 | Calamatas | 318/466 |
| 6,469,499 | B2 * | 10/2002 | Delaporte | 324/207.13 |
| 6,530,178 | B1 | 3/2003 | Kowalczyk et al. | |
| 6,553,717 | B2 | 4/2003 | St. John et al. | |
| 6,634,140 | B1 | 10/2003 | Sellman | |
| 6,719,356 | B2 * | 4/2004 | Cleland et al. | 296/146.8 |
| 6,754,990 | B2 | 6/2004 | Pedemonte | |
| 6,786,006 | B2 | 9/2004 | Kowalczyk et al. | |
| 6,786,671 | B1 | 9/2004 | Eckendorff | |
| 6,794,837 | B1 * | 9/2004 | Whinnery et al. | 318/282 |
| 6,822,410 | B2 * | 11/2004 | Whinnery et al. | 318/469 |
| 6,938,372 | B2 | 9/2005 | Kennedy et al. | |
| 7,298,107 | B2 | 11/2007 | McMahon | |
| 7,310,911 | B1 | 12/2007 | Sellman | |
| 7,316,096 | B2 | 1/2008 | Houser et al. | |
| 7,339,336 | B2 | 3/2008 | Gregori | |
| 7,405,530 | B2 | 7/2008 | Keller, Jr. | |
| 7,509,772 | B2 * | 3/2009 | Ohta et al. | 49/334 |
| 7,726,722 | B2 | 6/2010 | Ray | |
| 2002/0104266 | A1 * | 8/2002 | Ranaudo | 49/334 |
| 2002/0105319 | A1 * | 8/2002 | Delaporte | 324/207.13 |
| 2003/0025469 | A1 * | 2/2003 | Zhou et al. | 318/34 |
| 2003/0222610 | A1 * | 12/2003 | Whinnery | 318/362 |
| 2003/0222614 | A1 * | 12/2003 | Whinnery et al. | 318/461 |
| 2003/0225497 | A1 * | 12/2003 | Whinnery | 701/49 |
| 2004/0068935 | A1 | 4/2004 | Ichikawa et al. | |
| 2004/0124662 | A1 * | 7/2004 | Cleland et al. | 296/146.4 |
| 2005/0161973 | A1 * | 7/2005 | Yokomori | 296/155 |
| 2005/0168010 | A1 * | 8/2005 | Cleland et al. | 296/146.8 |
| 2006/0181108 | A1 * | 8/2006 | Cleland et al. | 296/146.4 |
| 2006/0288642 | A1 * | 12/2006 | Marentette | 49/26 |
| 2007/0285812 | A1 * | 12/2007 | Foote et al. | 359/877 |
| 2008/0277964 | A1 * | 11/2008 | Kanno et al. | 296/146.1 |
| 2008/0309120 | A1 | 12/2008 | Kohlstrand et al. | |
| 2009/0260289 | A1 * | 10/2009 | Carpenter et al. | 49/26 |
| 2010/0101147 | A1 * | 4/2010 | Vankrunkelsven | 49/334 |
| 2012/0144744 | A1 * | 6/2012 | No | 49/31 |

* cited by examiner

VEHICLE DOOR SWING GOVERNOR

FIELD OF THE INVENTION

The present invention generally relates to a device for use on an automotive vehicle door, and more particularly to a door swing governor for limiting the velocity of the swing of a vehicle door.

BACKGROUND OF THE INVENTION

Motor vehicle doors may include device(s) to sense a nearby object that might be contacted when opening the vehicle door for ingress and egress. When opened, if the vehicle door swings fast enough or hits the object hard enough, damage to the door may be sustained. These devices sense the distance to the object, typically using a sensor(s) located on the exterior surface of the door, and determine if it is within the door's projected swing path. The device is then able to slow the door, thus preventing damage to the door and object.

SUMMARY OF THE INVENTION

According to one aspect of the present invention, a vehicle door swing governor positioned between a door and a body of a vehicle is provided. The door swing governor includes a motor operably coupled to the door and a controller for controlling the mechanical resistance applied by the motor to the door to control velocity of the door swing. The mechanical resistance applied to the door is a function of the velocity of the swing of the door.

According to another aspect of the present invention, a vehicle door assembly is provided. The vehicle door assembly comprises a vehicle door and a door swing governor positioned between the door and a body of the vehicle. The door swing governor includes a motor operably coupled to the door and a controller for controlling the mechanical resistance applied by the motor to the door to control velocity of the door swing. The mechanical resistance applied to the door is proportionate to the velocity of the door swing.

According to yet another aspect of the present invention, a method of controlling the velocity of swing of a vehicle door is provided. The method includes the steps of sensing the door swing velocity using a motor operating as a generator when the motor spins in a first direction and applying an electrical load to the motor in response to the sensed velocity, causing the motor to generate a force in a second direction, thereby controlling the mechanical resistance applied by the motor to the door to control the velocity of the door.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
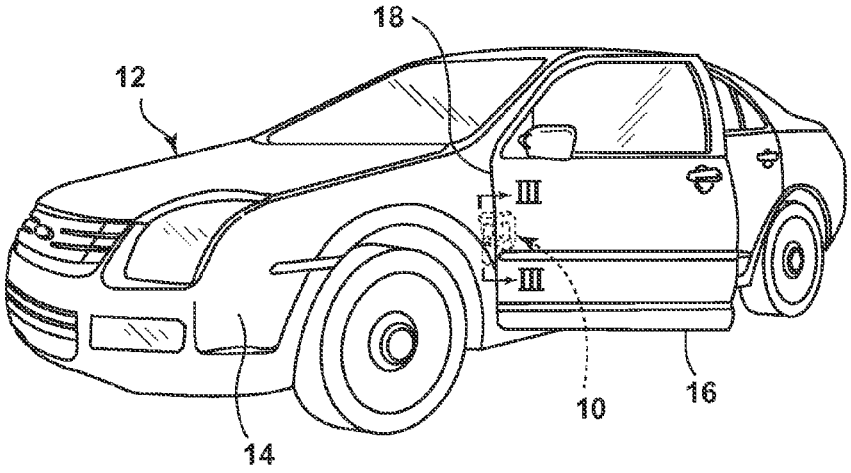
FIG. 1 is a perspective view of a vehicle having a door swing governor according to an embodiment of the present invention.

For purposes of description herein, the terms "upper," "lower," "right," "left," "rear," "front," "vertical," "horizontal," "interior," "exterior," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawing, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
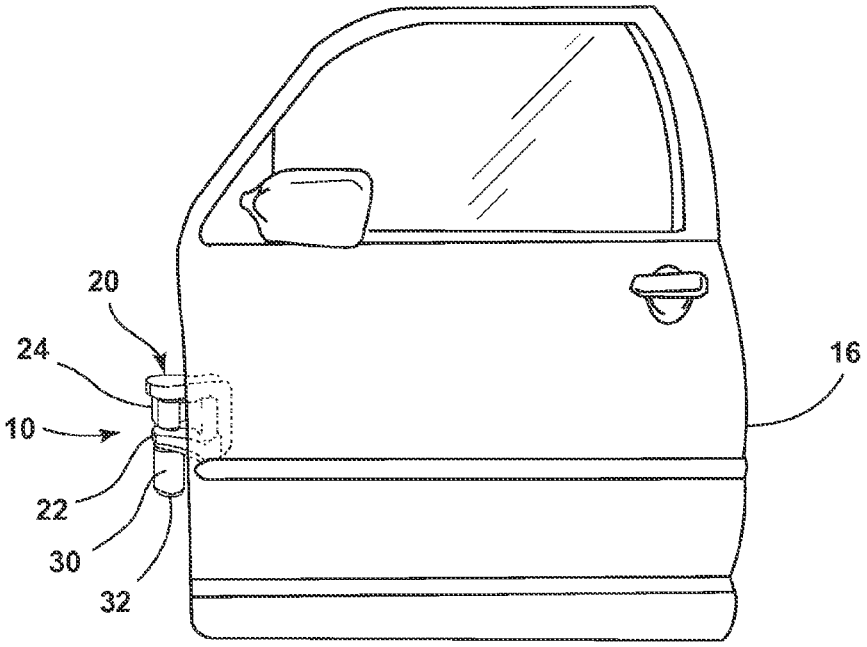
FIG. 2 is a side view of a door of the vehicle of FIG. 1 and the door swing governor.
Figure 3:
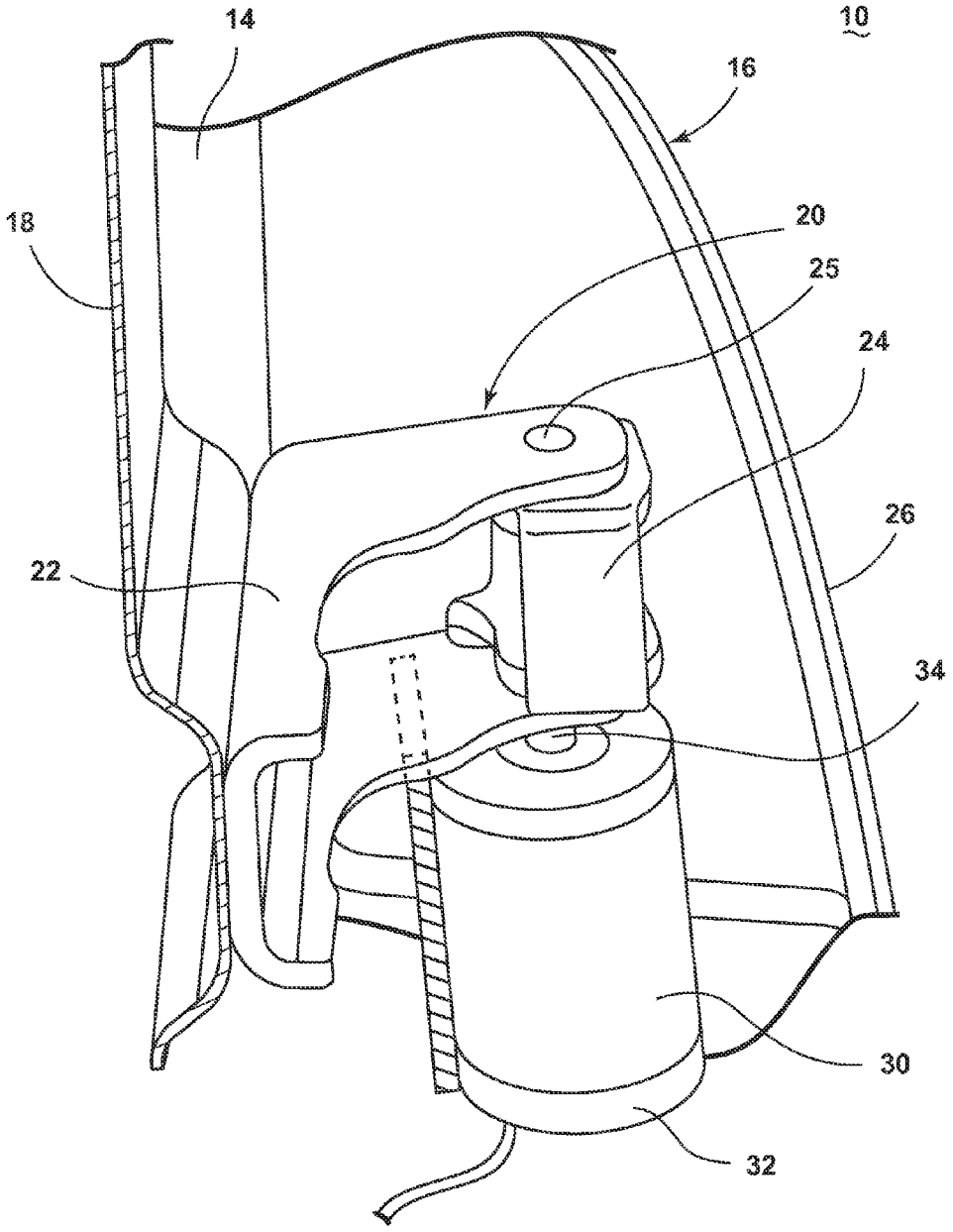
FIG. 3 is an enlarged sectional view, partially in elevation, of the door and door swing governor, taken along line III-III of FIG. 1.

Referring to FIGS. 1-3, reference numeral 10 generally designates one embodiment of a door swing governor. FIG. 1 illustrates an exemplary motor (automotive) vehicle 12, having a vehicle body 14 upon which a door 16 is rotatably mounted. The door 16 illustrated is a side door, specifically a driver's door; however, any vehicle door is contemplated to employ the door swing governor 10. Further, the size, weight, geometry, and maximum opening angle will vary by vehicle. The door 16 is shown hinged to an A-pillar 18 of the vehicle body 14 by means of a hinge 20. The hinge 20 is defined by a fixed hinge half 22 and a moveable hinge half 24. The fixed hinge half 22 is mounted to the A-pillar 18, or to another suitable automotive body structure, such as a B-pillar. The fixed hinge half 22 can be affixed to the body structure by means of welding, threaded fasteners, adhesives, or by any one or a combination of commonly known fastening methods.

The moveable hinge half 24 is rotatably mounted to the fixed hinge half 22 by a hinge pin 25 which rotates with the fixed hinge half 22 as the door 16 is opened or closed. The moveable hinge half 24 is attached to an inner door panel 26 by any suitable means, including those described above for attaching the fixed hinge half 22. While a single hinge 20 is shown, it should be appreciated that two or more hinges 20 may be employed to hingedly couple the door 16 to the vehicle body 14. Additionally, the fixed and moveable hinge halves 22, 24 may be mounted in reverse orientation to that illustrated in FIG. 3.

As best seen in FIG. 3, the governor 10 is positioned between the door 16 and the vehicle body 14 and comprises a motor 30 and a controller 32. The motor 30 is operably coupled to the door 16, and more specifically is operatively connected to the hinge 20 and is disposed on or near the hinge 20. In the illustrated example, the motor 30 is shown mounted below the hinge 20, though other locations, such as above the hinge 20 or operably coupled to a door check system associated with the door 16, are contemplated. A rotatable shaft 34 of the motor 30 is operably connected to the moveable hinge half 24 for applying resistance thereto. Optionally, the shaft 34 may extend through the hinge 20, eliminating the need for a separate hinge pin 25, as described above. Additionally, although the controller 32 is illustrated as directly mounted to, or integral to the motor 30, it is contemplated that the controller 32 may be located separately from the motor 32.

According to one embodiment, the motor 30 is a reversible, direct-current (DC) motor II that functions as a generator when rotated in a first direction (OPEN). The first direction (OPEN) is defined by the door swing associated with opening the vehicle door 16. Oppositely, a second direction (CLOSE) is defined by the door swing associated with closing the vehicle door 16. The controller 32 is in electrical communication with the motor 30 and is adapted for controlling a mechanical resistance (R) applied by the motor 30 to the door 16 so as to control a velocity (v) of the door swing when the door 16 is rotated open.

The electric motor 30 may include a brushed or brushless motor or other motor according to various embodiments. The motor 30 has a rotary armature coil inside of a stationary magnetic field. The motor 30 may be driven to rotate the armature coil and shaft 34 in the second direction to generate a force output. The shaft 34 and armature coil may be rotated in the first opposite direction when the vehicle door 16 is forcibly opened by a user. When this occurs, the armature coil induces a voltage (V) as it rotates relative to the stationary magnetic field, so as to act like a generator. The voltage (V) is indicative of the velocity of door swing.

Figure 4:
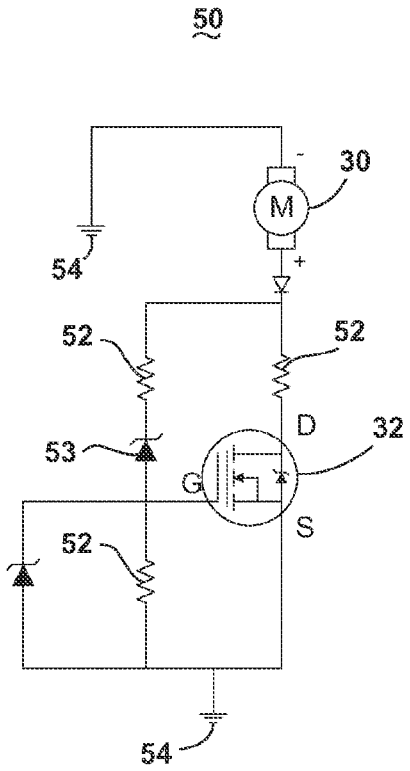
FIG. 4 is a circuit diagram of the door swing governor of FIG. 1, according to one embodiment.

An electrical schematic representing an electrical circuit 50 for the governor 10 is illustrated in FIG. 4. The circuit 50 includes the motor 30, the controller 32, several resistors 52, and at least one ground 54. According to one embodiment, the controller 32 includes a transistor 32 which is used for controlling a load applied to the motor 30. The transistor 32 is able to detect the voltage (V) created by the motor 30 when acting as a generator and apply a variable load to the motor 30. This may be achieved by the voltage (V) at the gate of the transistor 32 sourcing current through the transistor 32. An optional zener diode 53 may be employed to delay the generation of the resistive force until a certain door velocity is reached. One example of a suitable transistor 32 is a MOSFET transistor 32, though other suitable types of transistor 32*s* are contemplated. The controller may include other analog and/or digital circuitry for both controlling and protecting the door swing governor 10.

In operation, when the door 16 is swung open by a user, the manually induced opening of the door 16 causes the generator to spin in the first direction (OPEN). The spinning generator generates a resultant voltage (V) across the motor 30, which is detected by the transistor 32 through appropriate biasing circuitry. The transistor 32 then applies an increasing load across the motor 30 in response to the voltage (V) created by the generator. The resistive load applied to the motor 30 by the transistor 32 causes the motor 30 to generate a force in the second direction (CLOSE), thereby applying mechanical resistance (R), or force, to the door 16 and decreasing the velocity of the swing of the door 16 when the door 16 is rotated open. Additionally, it is contemplated that mechanical resistance (R) is not applied to the door 16 when the door is rotated closed, though it certainly is feasible. When closing the door 16, the governor 10 may be selectively disabled.

Figure 5A:
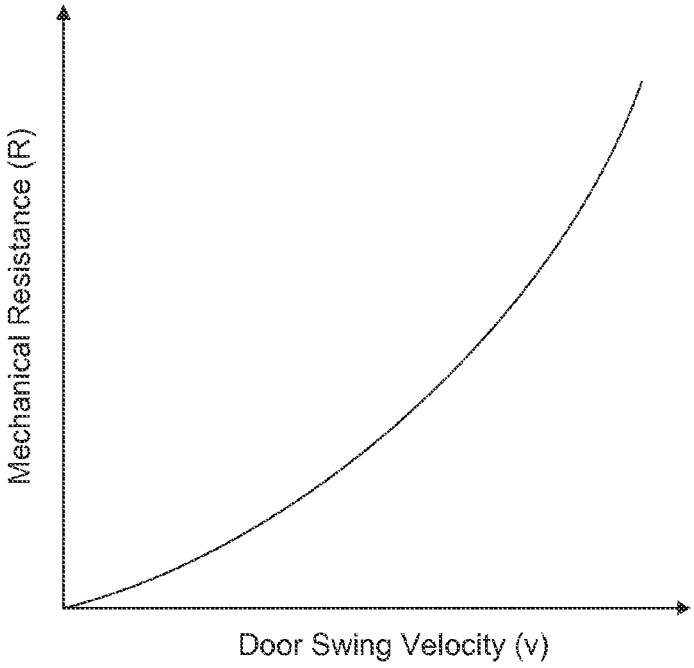
FIG. 5A is a graphical representation of the relationship between the door swing velocity and the mechanical resistance applied to the door by the door swing governor when the circuit diagram does not include a zener diode.
Figure 5B:
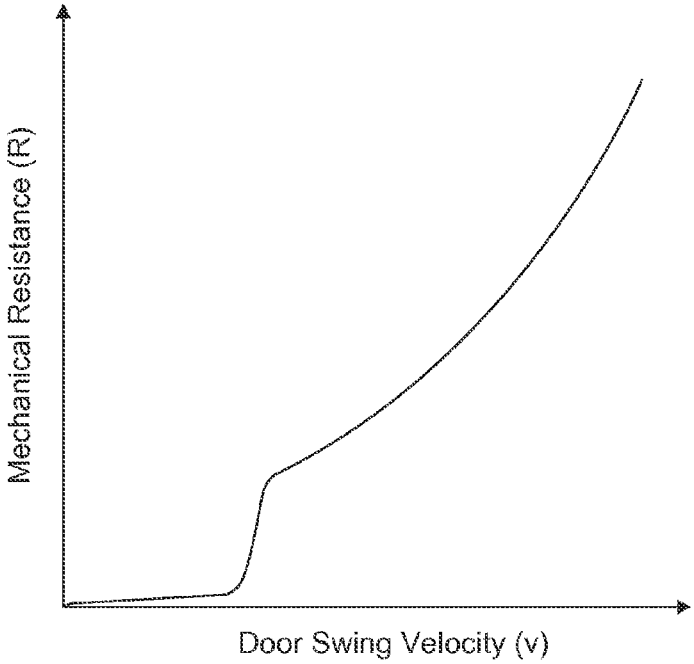
FIG. 5B is a graphical representation of the relationship between the door swing velocity and the mechanical resistance applied to the door by the door swing governor when the circuit diagram includes the zener diode.

Accordingly, the mechanical resistance (R) applied to the door 16 is a function of the velocity (v) of the swing of the door 16. FIG. 5A is a graphical representation of the relationship between the door swing velocity (v) and the mechanical resistance (R) applied to the door 16 when the electrical circuit of the door swing governor 10 does not include the zener diode 53. The example illustrated shows an exponential relationship between the door swing velocity (v) and the mechanical resistance (R) applied to the door 16. The voltage (V) created by the generator is a function of the velocity (v) of the door swing. In other words, the faster the manually induced swing of the door 16, the greater will be the mechanical resistance (R) applied to the door 16 by the motor 30. Thus, utilizing an exponential relationship, the door swing governor 10 is self-limiting. It should be noted that other functional relationships between the door swing velocity (v) and the mechanical resistance (R) applied to the door 16 may be utilized. For example, the functional relationship may be linear. Further, the functional relationship can be controlled by the selection of the particular biasing circuit, controller, or transistor used in the electrical circuit 50 or by a more advanced design. Additionally, FIG. 5B is a graphical representation of the relationship between the door swing velocity (v) and the mechanical resistance (R) as applied to the door 16 when the electrical circuit of the door swing governor 10 also includes the zener diode 53.

Figure 6:
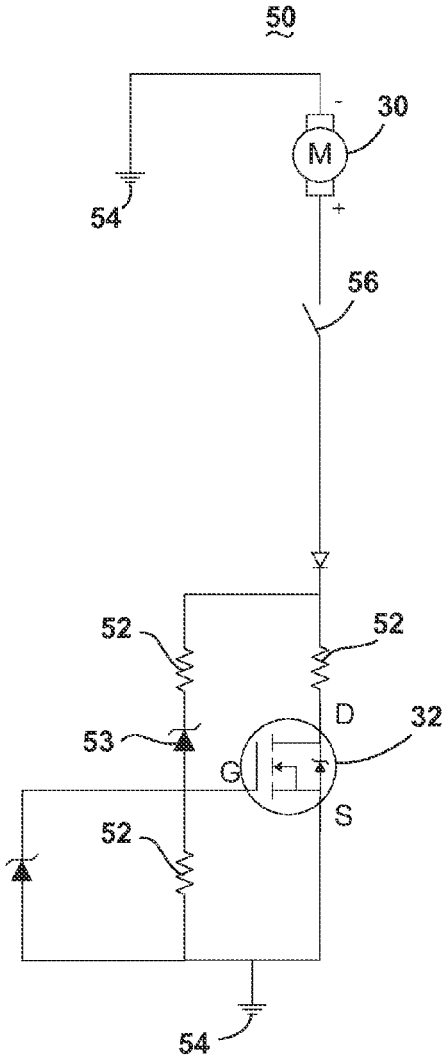
FIG. 6 is a circuit diagram of the door swing governor, according to one embodiment.

In another embodiment illustrated in FIG. 6, the electrical circuit 50 may also include one or more additional switches 56 for disabling the door swing governor 10. The switch 56 may be mechanical or electrical and, in the case of an electrical switch, could be actuated remotely. For example, the switch 56 may be in the form of an exterior door handle switch for detecting that the door 16 is being opened from the exterior, in which case the door swing governor 10 could be considered unnecessary. The switch 56 could break the electrical circuit 50, effectively overriding the door swing governor 10. In another example, the switch 56 could be in the form of a child switch that detects that the child lock associated with the door 16 is activated, thus only allowing the door 16 to be opened from the exterior and deactivating the door swing governor 10

Figure 7:
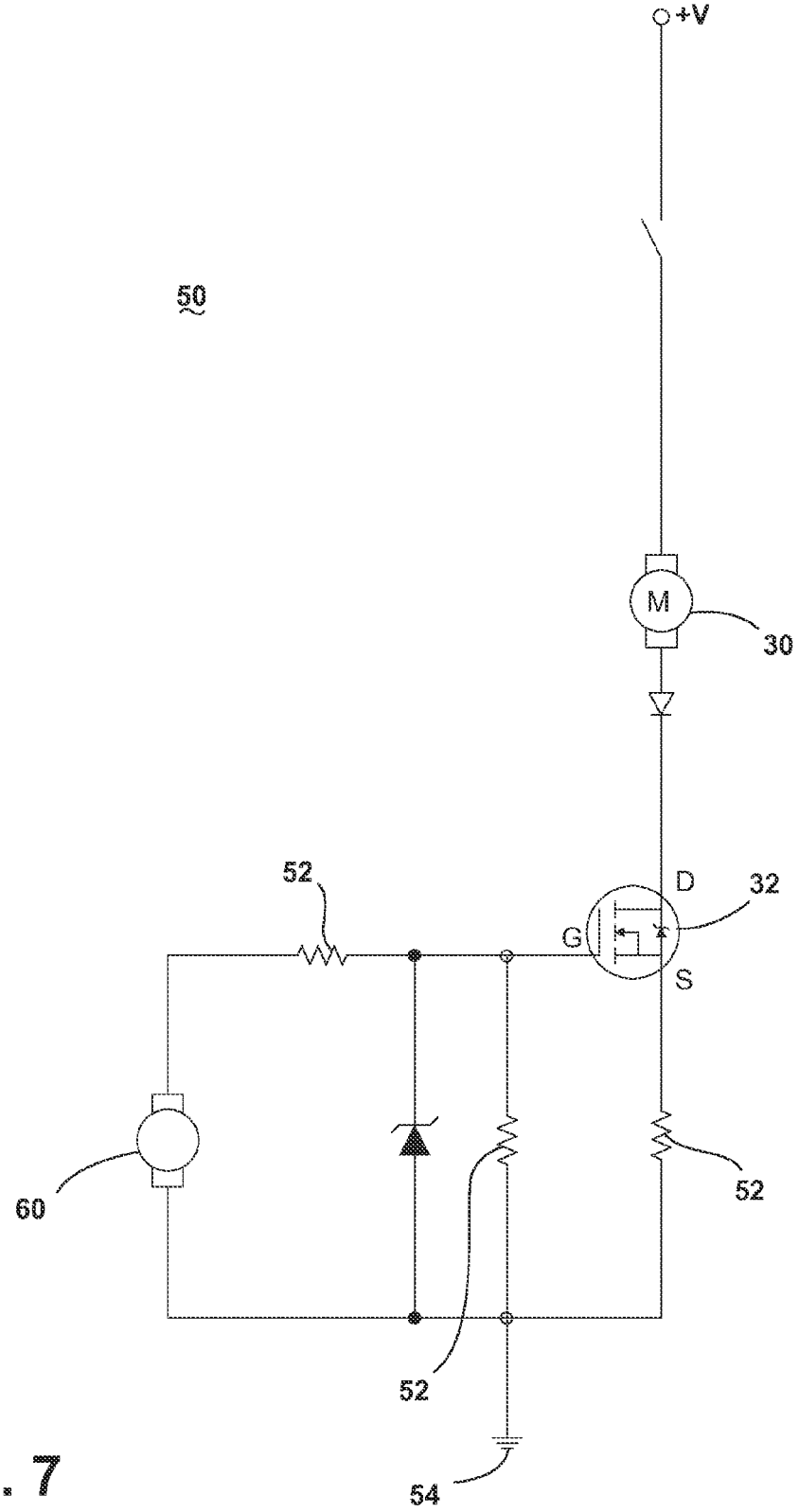
FIG. 7 is a circuit diagram of the door swing governor, according to one embodiment.
Figure 8:
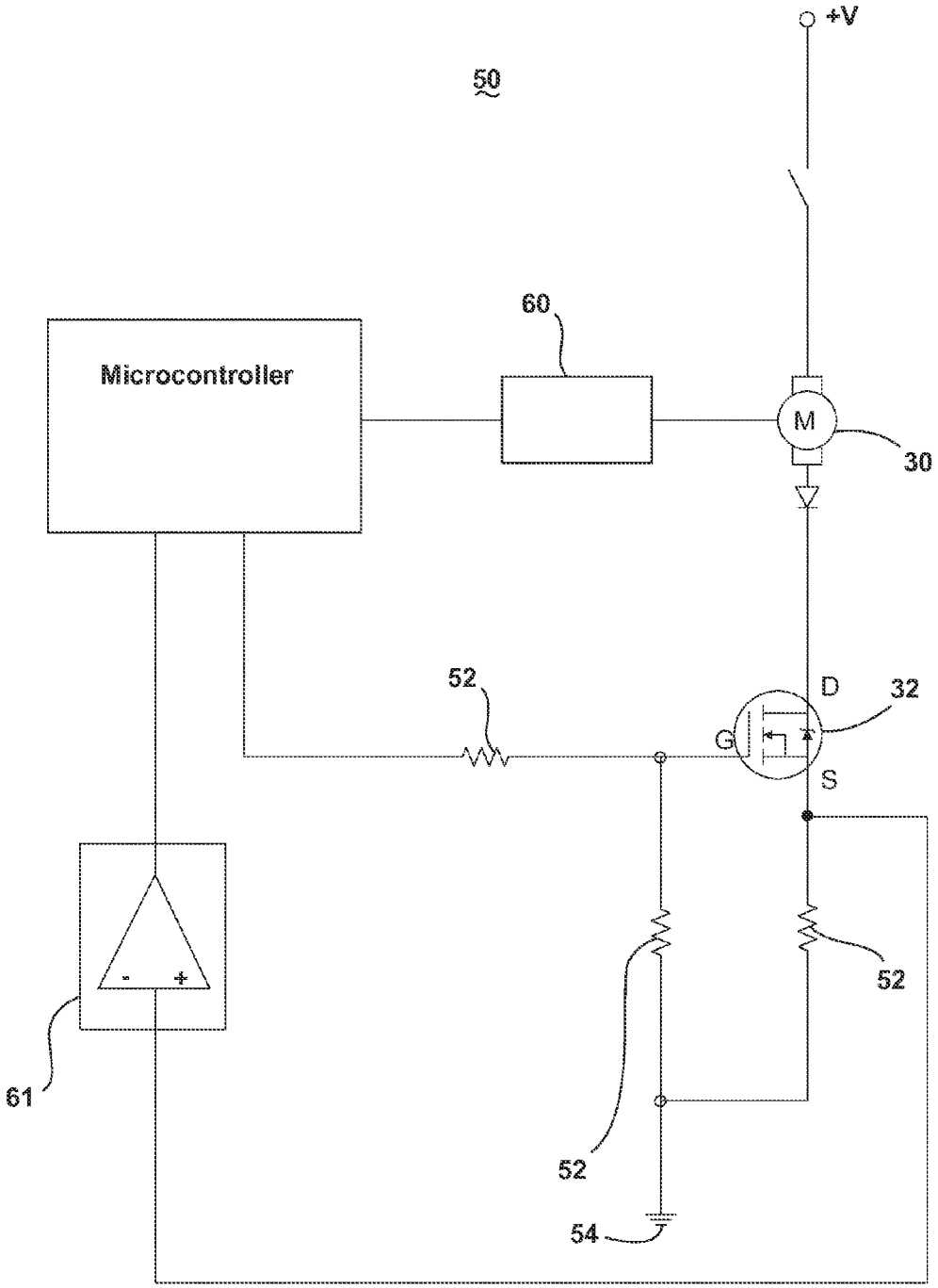
FIG. 8 is a circuit diagram of the door swing governor, according to one embodiment.

In yet another embodiment illustrated in FIG. 7, the governor 10 may also include a velocity sensor 60 for sensing the velocity (v) of the door 16 swing. The velocity sensor 60 could be in the form of a second DC motor or generator mechanically coupled to the motor shaft 34, a Hall Effect sensor, a sensor and a control module for interpreting the velocity, or any other suitable means for sensing velocity. The velocity sensor 60 is included in the circuit 50 in addition to the motor 30. In this embodiment, the transistor 32 controls current through the motor 30 in response to the velocity (v) of the door swing as sensed by the velocity sensor 60. The example illustrated in FIG. 8 includes a Hall Effect sensor 60, a microcontroller and an operational amplifier (op amp) 61 for sensing the velocity (v) of the door swing. In the embodiments illustrated in FIGS. 7 and 8, the governor 10 causes the motor 30 to be driven in the second direction (CLOSE), to resist the manually induced opening of the door 16. Unlike the previously described embodiments, the motor 30 (acting as a generator) is not used to determine the voltage (V) generated by the motion of opening the door 16. Instead, the separate velocity sensor 60 is used to determine or sense the door swing velocity (v). The transistor 32 then conducts current to the motor 30 in proportionate response to the sensed door swing velocity (v), as sensed by the velocity sensor 60.

The door swing governor 10 offers several benefits or advantages that can be utilized on vehicle doors. The governor 10 aids a user in maintaining control of the door, even in situations when the door swings out of control due to windy conditions, when the vehicle is parked on an incline, or other similar situations. Mechanical resistance (R) can be applied to the door 16 as the door is opened, but disabled as the door 16 is being closed so that the door closing efforts are not affected. Further, the door swing governor 10 can be easily overridden using simple software or electronic or mechanical switches, which break the circuit 50 and disable the governor 10. Additionally, the door swing governor 10 does not require sensors mounted to the exterior side of the door as many of the currently available systems do. This is an improvement from both a cost and vehicle styling standpoint.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A vehicle door swing governor positioned between a door and a body of a vehicle, the governor comprising:

an electric motor operatively coupled to the door and configured to function as a generator to apply a variable mechanical resistance; and a controller configured to control the mechanical resistance applied by the electric motor to the door in response to a voltage generated by the motor due to a swing of the door induced by an applied load, wherein the mechanical resistance applied to the door is a function of the velocity of the swing, wherein the swing of the door causes the electric motor to rotate in a first direction and generates the voltage, and the controller detects the voltage generated by the electric motor.

2. The door swing governor of claim 1, wherein the controller comprises a transistor for applying a load through the electric motor.

3. The door swing governor of claim 1, wherein the electric motor is a direct-current motor that functions as a generator with a variable load.

4. The door swing governor of claim 1, wherein a transistor controls the current through the electric motor in response to the voltage generated by the electric motor.

5. The door swing governor of claim 4, wherein the applied load causes the electric motor to generate a force in an opposite second direction, thereby applying mechanical resistance to the door and decreasing the velocity of the swing of the door.

6. The door swing governor of claim 1, wherein the controller is further operable to measure the velocity of the swing of the door and increase the mechanical resistance relative to the velocity.

7. The door swing governor of claim 1, further comprising a sensor for sensing the velocity of the swing of the door.

8. The door swing governor of claim 7, wherein a transistor conducts current to the electric motor in response to the velocity of door swing as sensed by the sensor.

9. The door swing governor of claim 7, wherein the electric motor is configured to function as the sensor.

10. A vehicle door assembly comprising:

a vehicle door;

a door swing governor positioned between the door and a body of the vehicle, the governor comprising:

an electric motor operably coupled to the door and configured to function as a generator and configured to function as a generator to apply a variable mechanical resistance; and a controller controlling the mechanical resistance applied by the electric motor to the door in response to a swing of the door induced by an applied load, wherein the mechanical resistance applied to the door is a function of the velocity of the swing as measured by a voltage generated by the electric motor, wherein the swing of the door causes the electric motor to spin in a first direction and the applied load causes the electric motor to generate force in an opposite second direction, thereby applying the mechanical resistance to the door and decreasing the velocity of the swing.

11. The door assembly of claim 10, wherein the controller comprises a transistor for applying a load through the electric motor.

12. The door assembly of claim 10, wherein the electric motor is a direct-current motor that functions as a generator with a variable load.

13. The door assembly of claim 12, wherein the swing of the door causes the electric motor to generate a resultant voltage, and the controller detects the resultant voltage generated by the electric motor.

14. The door assembly of claim 13, wherein a transistor controls the current through the electric motor in response to the voltage generated by the electric motor.

15. The door assembly of claim 10, wherein the controller increases the mechanical resistance in response to an increase in the velocity of the door.

* * * * *